United States Patent [19]

Schuelke et al.

[11] Patent Number: 4,832,152

[45] Date of Patent: May 23, 1989

[54] ACOUSTIC TILE

[75] Inventors: David J. Schuelke; Randy H. Barnard, III, both of Grand Rapids; Kenneth E. Kleinke, East Grand Rapids, all of Mich.

[73] Assignee: Herman Miller, Inc., Zeeland, Mich.

[21] Appl. No.: 171,576

[22] Filed: Mar. 22, 1988

[51] Int. Cl.[4] ..... E04B 1/82

[52] U.S. Cl. ..... 181/290; 181/286; 181/287; 181/291; 181/294; 181/295

[58] Field of Search ..... 181/284, 286, 290, 291, 181/294, 295, 287

[56] References Cited

U.S. PATENT DOCUMENTS

| | | | |
|---|---|---|---|
| 1,554,180 | 9/1925 | Trader | 181/293 X |
| 2,192,516 | 3/1940 | Cunnington . | |
| 2,285,423 | 6/1942 | Esser | 181/290 |
| 2,328,761 | 9/1943 | Wamnes et al. . | |
| 2,694,025 | 11/1954 | Slayter et al. | 181/284 X |
| 2,887,173 | 5/1959 | Boschi | 181/286 |
| 2,902,854 | 9/1959 | Greene . | |
| 2,966,954 | 1/1961 | Sabine | 181/289 |
| 3,061,056 | 10/1962 | Kodaras | 181/290 X |
| 3,084,402 | 4/1963 | Jordan, Jr. et al. | 181/290 X |
| 3,094,188 | 6/1963 | D'Eustachio | 181/293 |
| 3,103,255 | 9/1963 | Boschi et al. | 181/293 |
| 3,132,714 | 5/1964 | Gary, Jr. et al. | 181/286 |
| 3,166,149 | 1/1965 | Hulse et al. | 181/292 |
| 3,211,253 | 10/1965 | Gonzalez | 181/292 |
| 3,232,372 | 2/1966 | Boschi | 181/290 |
| 3,239,973 | 3/1966 | Hannes et al. | 52/144 |
| 3,384,199 | 5/1968 | Eckel | 181/290 |
| 3,441,465 | 4/1969 | Pearson | 181/290 X |
| 3,448,823 | 6/1969 | Smith | 181/290 |
| 3,502,171 | 3/1970 | Cowan | 181/292 |
| 3,597,891 | 8/1971 | Martin | 52/144 |
| 3,712,846 | 1/1973 | Daniels et al. | 181/290 X |
| 3,713,508 | 1/1973 | Eckel | 181/287 |
| 3,858,676 | 1/1975 | Le Masurier | 181/286 |
| 3,949,827 | 4/1976 | Witherspoon | 181/284 |
| 4,093,482 | 6/1978 | Ogata et al. | 181/290 X |
| 4,112,164 | 9/1978 | Koss | 181/286 X |
| 4,113,053 | 9/1978 | Matsumoto et al. | 181/284 |
| 4,152,474 | 5/1979 | Cook et al. | 181/291 X |
| 4,155,211 | 5/1979 | Saylor et al. | 181/295 X |
| 4,163,479 | 8/1979 | Bschorr | 181/286 |
| 4,213,516 | 7/1980 | Sulewsky | 181/286 |
| 4,248,325 | 2/1981 | Georgopoulos | 181/284 |
| 4,441,580 | 4/1984 | Webster | 181/286 |
| 4,621,709 | 11/1986 | Naslund | 181/287 X |

*Primary Examiner*—B. R. Fuller

*Attorney, Agent, or Firm*—Varnum, Riddering, Schmidt & Howlett

[57] ABSTRACT

An acoustic tile that provides soundproofing in a modular wall, such as is used in a modular panel office system, comprises a rigid rectangular metallic frame, a septum formed of a calcium carbonate-filled molded synthetic rubber polymer, a layer of low-density fiberglass and a layer of high-density fiberglass. The front of the frame is covered by fabric, and the back of the frame has fittings to attach the acoustic tile to a wall panel.

23 Claims, 6 Drawing Sheets

ACOUSTIC TILE

BACKGROUND OF THE INVENTION

1. Field of the Invention

This invention relates to acoustic tiles that are installed on wall panels such as are used for modular office systems. Specifically, it relates to a tile with an improved septum which enhances the flexibility of the tile while maintaining excellent sound dampening qualities.

2. Description of the Prior Art

Acoustical panels are used to dampen sound transmission in many office settings. Panels that accomplish this task are disclosed in U.S. Pat. Nos. 3,712,846; 3,949,827; 4,213,516; and 4,441,580. In some office arrangements, it is desirable to have the workspace divided into several individual work areas by partitions which form a modular office system. Such an arrangement is disclosed in U.S. Pat. No. 4,685,255. These modular office systems typically consist of a framework on which are removably fastened a plurality of acoustic tiles that function to dampen sound waves.

An acoustic tile for a modular wall system is disclosed in U.S. Pat. No. 3,949,827. However, the prior art acoustical tiles have limited flexibility because septums are typically made of metal. This lack of flexibility prevents the tile from easily accommodating interior electrical components which may protrude into the sapce normally used by the acoustic tile. A tile with a flexible septum easily accommodates the interior electrical component. A flexible septum also facilitates the use of automatic fabric wrapping equipment to assemble a fabric overwrap onto the acoustic tile, thereby saving time and money in the tile assembly process.

SUMMARY OF THE INVENTION

According to the invention, there is provided an acoustic tile for mounting to a rigid frame to provide sound transmission attenuation and sound-deadening characteristics to a wall which includes one or more of the acoustic tiles. The acoustic tile comprises a relatively rigid frame defining an open central portion, a first acoustic layer of a high-density acoustic material, a second acoustic layer of relatively compressible low-density acoustic material and a septum formed of a flexible and yieldable sound-transmission attenuation material. The first acoustic layer, the second acoustic layer and the septum all conform to the perimetric shape of the frame and are mounted within the open central portion thereof with the first acoustic layer being in facing relationship with the second acoustic layer and the second acoustic layer being in facing relationship to the septum.

The frame is preferably made from a rigid material such as metal to give rigidity to the frame. The frame is structurally supported by the first acoustic layer which is a relatively rigid material. Preferably, the first acoustic layer is made of a compressed fiberglass or similar acoustical quality material and has a thickness in the range of 0.4375 to 0.5625 inch, preferably about 0.5 inches. The acoustic layer is relatively dense and has a density in the range of 3.6 to 4.0 pounds per cubic foot, preferably about 3.6 pounds per cubic foot.

The second acoustic layer is made from a fiberglass or similar acoustic quality material of lower density than the first acoustic layer. The density of the second acoustic layer can vary between 0.6 and 0.8 pounds per cubic foot, and is preferably about 0.6 pounds per cubic foot. The thickness of the second acoustic layer can vary but generally is in the range of 0.9375 in. to 1.0625 in., preferably having a maximum thickness of about 1 inch.

Typically, a fabric wrap is provided around the frame and the first acoustic layer. Means are provided for removably mounting the rigid frame to a wall system frame.

The septum can be made from several different materials but is preferably made from a moldable rubbery polymer and is molded to a specific shape which may include at least one pan-shaped depression at a central portion thereof with the depression being filed with the second acoustic layer. Preferably, the moldable polymer is filled with a mineral of a relatively high density such as calcium carbonate. Other mineral fillers include barium sulfate. The thickness of the septum can vary but generally is considerably thinner than either the first or second acoustic layers. Preferably, the septum will have a thickness of about 0.05 inches but can have a thickness in the range of 0.05 to 0.06 inches.

The preferred moldable rubbery polymer from which the septum can be made is an ethylene/vinyl acetate copolymer having a calcium carbonate filler sold by E. I. duPont deNemours & Co. under the trademark KELDAX. A specific example of a suitable resin is a KELDAX 9158 resin having the density of 1.0 lbs. per cubic ft.

The thicknesses and densities of the first acoustic layer, the second acoustic layer and the septum are selected to provide a sound-transmission class rating of at least 28.

The moldability and flexibility of the septum provide a tile with acceptable sound-deadening and sound-transmission attenuating properties and yet one in which the tile is relatively light in weight, inexpensive in construction and flexible and yieldable to accommodate wiring components and other such components which may be included in a wall system adjacent to or inwardly of the acoustic tile.

DETAILED DESCRIPTION OF THE PREFERRED EMBODIMENT

Figure 1:
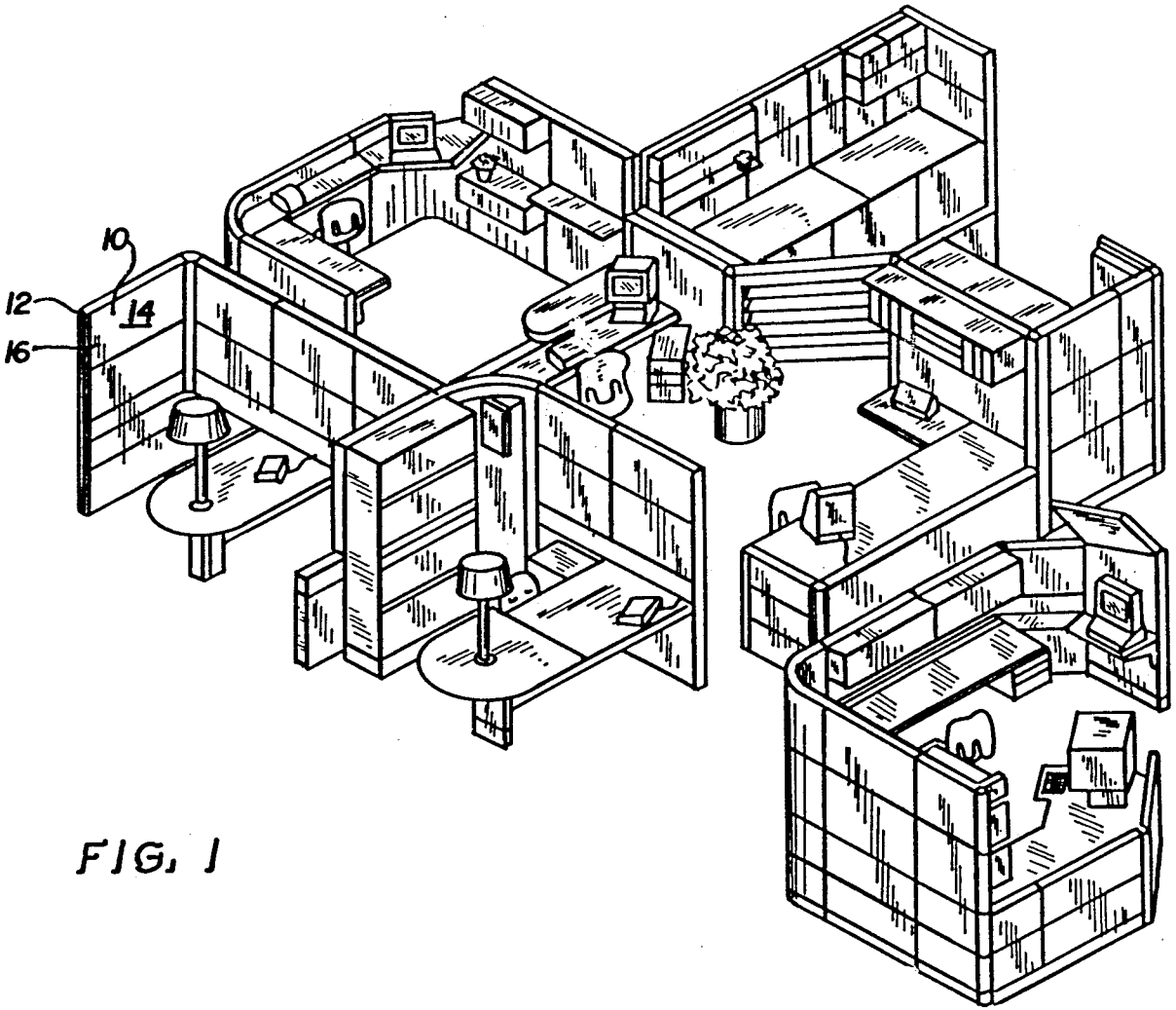
FIG. 1 is a perspective view of a modular office arrangement using the acoustical tile invention.
Figure 2:
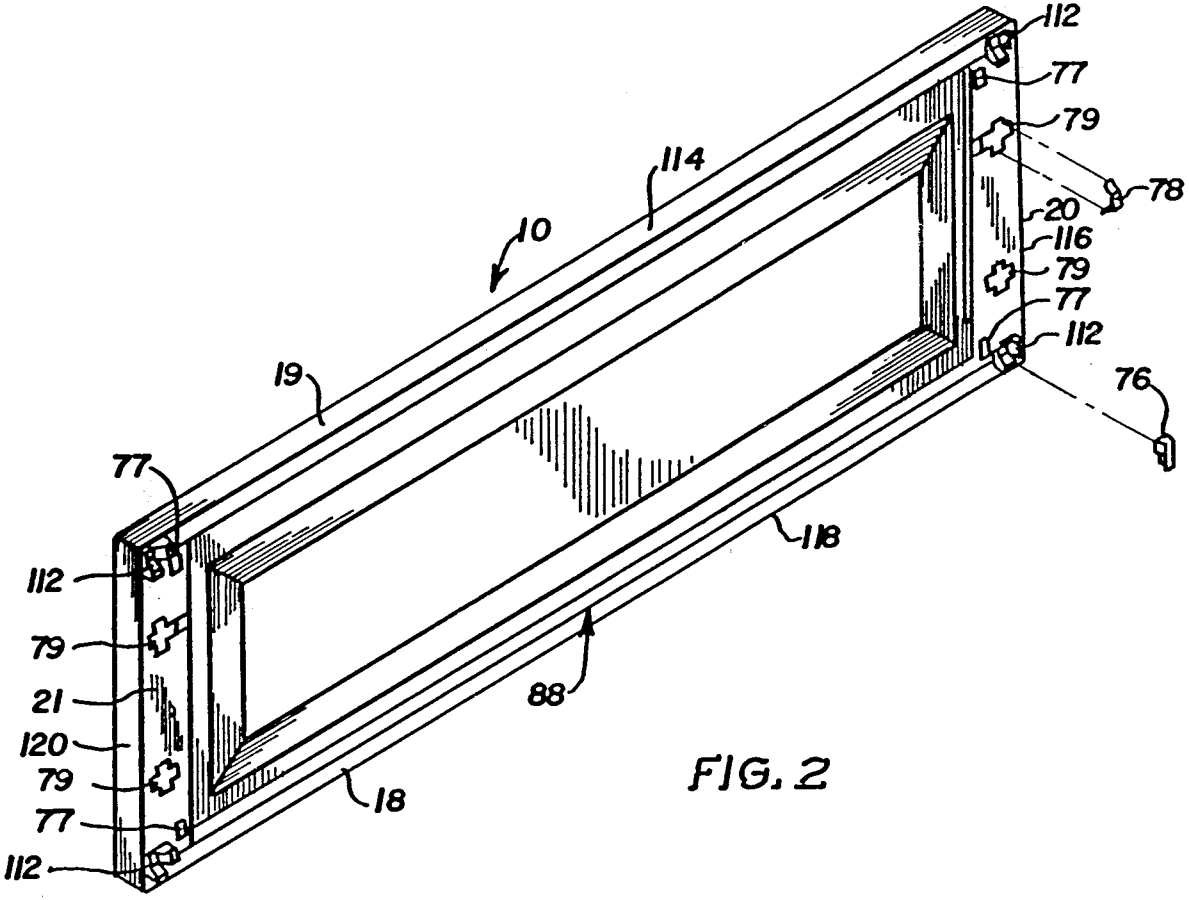
FIG. 2 is a rear perspective view of an acoustical wall tile constructed generally in accordance with the invention.

Referring to FIGS. 1 to 6, there is shown an acoustical wall tile 10 constructed generally in accordance with the invention. The tile 10 has the ability to reduce noise levels in offices and the like. The tile 10 is rectangular shape in frontal view and is attached to a wall frame 12 which is constructed to form modular office space as displayed in FIG. 1. Referring to FIG. 2, the tile 10 is adapted to be removably mounted on rigid frames through clips 78 and hooks 76 in the manner disclosed in the Kelley et al. U.S. Pat. No. 4,685,255.

Figure 11:
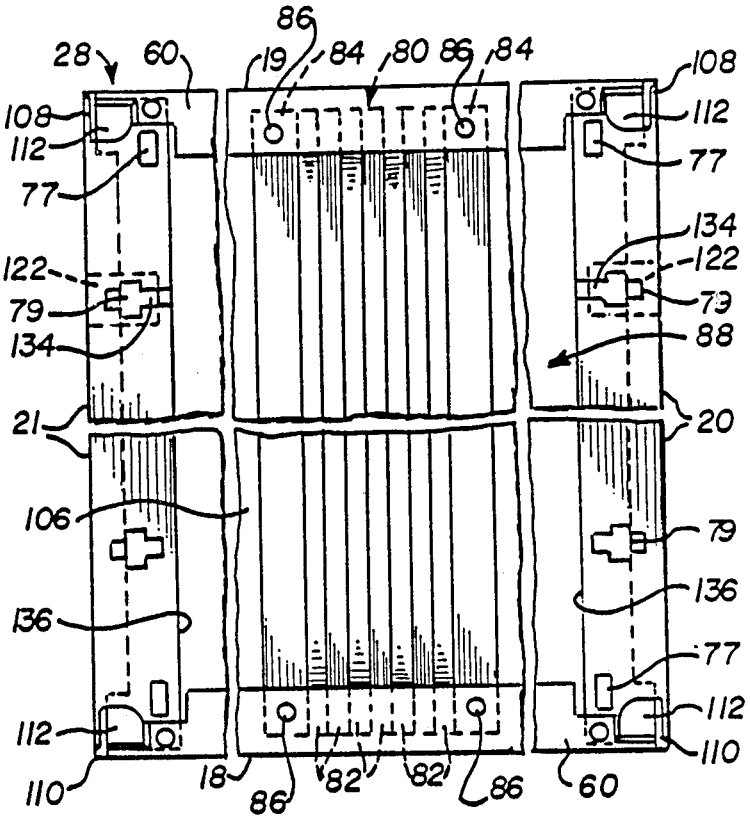
FIG. 11 is a fragmentary rear elevational view of the acoustical tile showing a cross brace.

Tiles 10 can be manufactured in a variety of lengths to fit different sizes of wall frames 12. Typical lengths includes 24, 30, 36, 42 and 48 inches. The larger sizes are able to span a plurality of wall frame segments. For example, a 48 inch long tile is able to span two 24 inch wide wall frame segments. In addition, for sizes larger than 30 inches, a cross brace 80 is provided for structural support as shown in FIG. 11. The brace 80 is a vertical member that is located on a back face 88 of the tile 10 as will hereinafter be described in detail.

There is a fabric overwrap 14 which covers a frontal face 16 of the tile 10. The frontal face 16 is that surface which faces a room having the sound energy source which is to be reduced. The overwrap 14 is securely attached to upper and lower rails 19, 18 and lateral side end caps 20, 21 with an adhesive. The rails 18, 19 and end caps 20, 21 are joined together to form a rigid tile frame 28.

Figure 3:
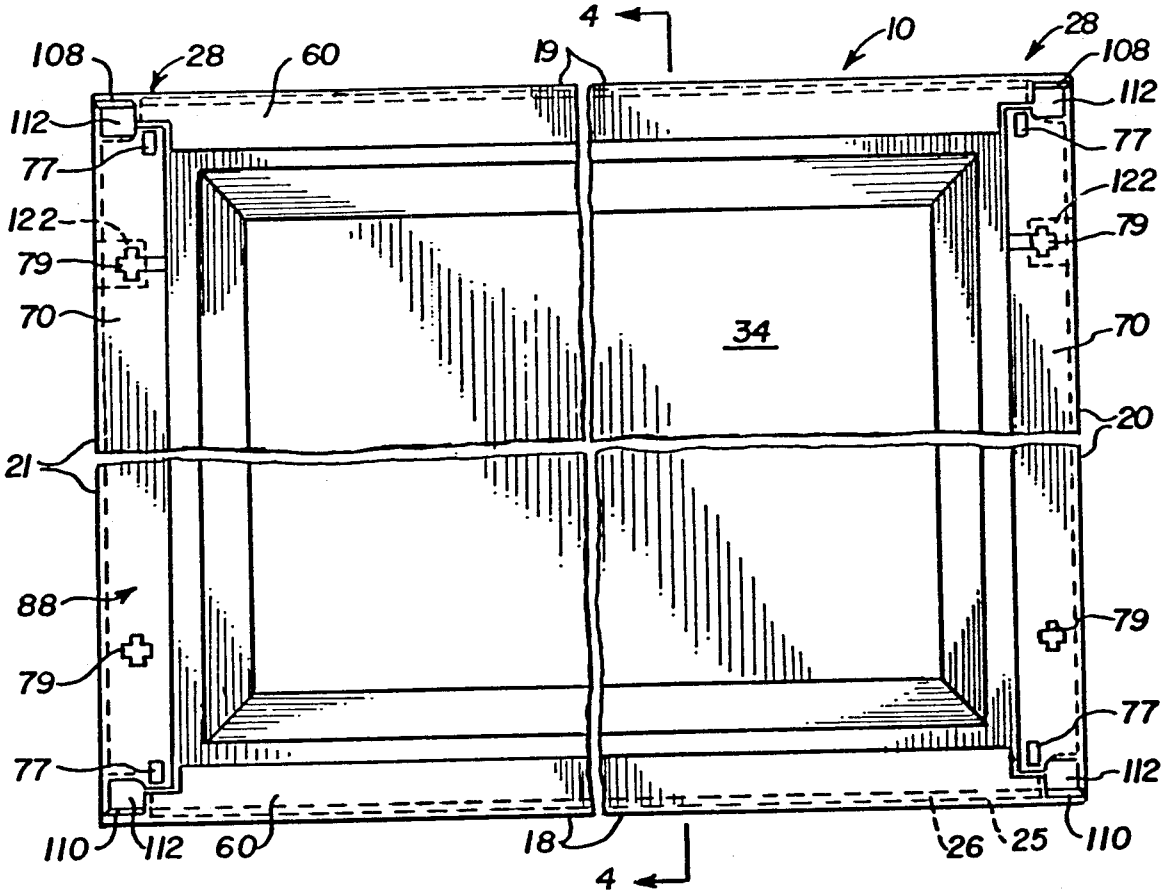
FIG. 3 is a fragmentary rear elevational view of the acoustical tile of FIG. 2.
Figure 7:
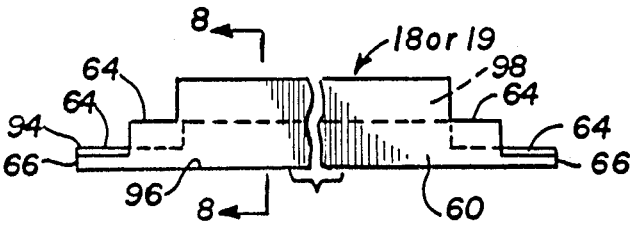
FIG. 7 is a fragmentary front elevational view of an upper or lower rail used in the acoustical wall tile according to the invention.
Figure 8:
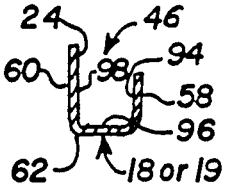
FIG. 8 is a cross-sectional view of the rails of FIG. 7 taken along lines 8—8 of FIG. 7.

The upper and lower rails 19, 18 shown in FIGS. 3, 7 and 8 are composed of a metal such as steel. The rails 18 are generally J-shaped in cross section and consist of a front portion 58, a rear portion 60 and a web portion 62. These portions from a channel 45. The front portion 58 is a predetermined height shorter than the rear portion 60. A septum 34 interfaces with a rail inner surface 98 at the rear portion 60. Bilateral stepped portions 64 located near the lateral edges 66 of the upper and lower rails 18 are necessary for tucking the overwrap 14 into the tile 10 and for assembling the tile frame 28 as will hereinafter be described in detail.

Figure 9:
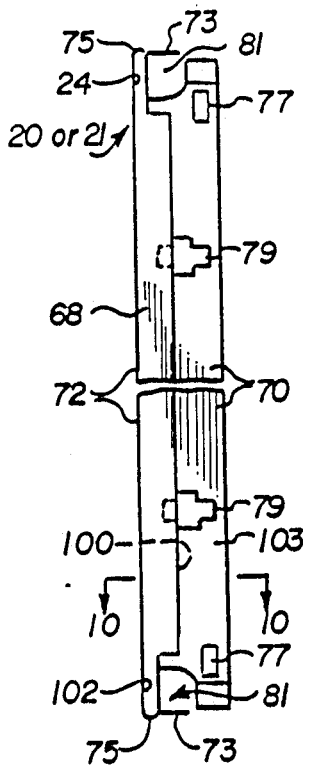
FIG. 9 is a fragmentary front elevational view of end caps used in the acoustical wall tile according to the invention.
Figure 10:
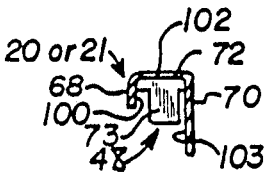
FIG. 10 is a cross-sectional view of the end caps of FIG. 9 taken along lines 10—10 of FIG. 9.

The end caps 20, 21 shown in FIGS. 3, 9 and 10, are composed of a metal such as steel. They are generally J-shaped in cross-section and consist of a front portion 68, a rear portion 70, a web portion 72, and projections 73 that are perpendicular to the front, rear and web portions 68, 70, 72, and are located at the upper and lower edges 75 of each end cap 20, 21. The height of the front portion 68 is a predetermined length shorter than the rear portion 70. The rear portion 70 has a plurality of holes 77, 79 and cutout portions 81 of predetermined geometric shapes whose function will hereinafter be described in detail.

Figure 4:
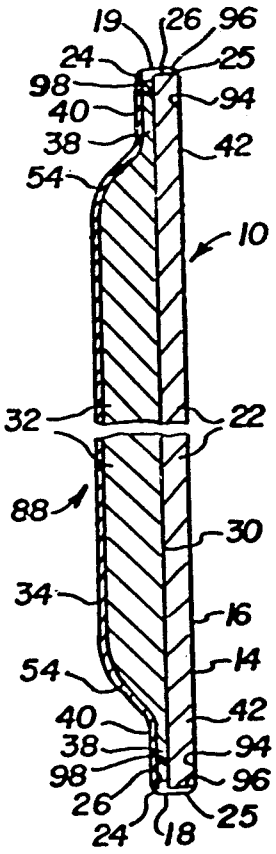
FIG. 4 is a fragmentary cross-sectional view of the tile of FIG. 2 taken along lines 4—4 of FIG. 3.

As illustrated in FIG. 4, there is a layer of a relatively rigid, high-density acoustical filler material 22 abutting the fabric overwrap 14. The function of the high-density material 22 is to dampen low-frequency sound waves. Material such as Manville 3.6 lb./cubic ft. compressed fiberglass is used for the high-density filler material 22. The high-density material 22 comprises a rectangular board with a standard thickness of 0.5 inches. In the furniture trade this is called "AWP board." Referring to FIGS. 4 and 7 to 10, the high density board 22 is dimensioned so it interfaces with the inner surfaces 94 and 96, of the rails 18, 19 and inner surfaces 100 and 102 of the end caps 20, 21. The high-density material 22 may incorporate a binder to give it structural integrity.

Referring to FIG. 4, adjacent to the high density board 22 inner face 30 (i.e., the face opposite the fabric overwrap 14) there is a layer of low density acoustical material 32. The function of the low-density material 32 is to dampen high-frequency sound waves. Material such as Manville 0.6 lb./cubic ft. Microlite is used for the low density material. The low density material 32 is initially in the general shape of a one-inch thick rectangular board. However, during the assembly process described below, it is compressed at the edges to conform generally to the contours of a septum 34. The compressed edges from flange portions 38.

The septum 34 for the acoustical tile 10 is shown in FIGS. 3 to 6. It is preferably formed from a mineral-filled molded synthetic rubber polymer such as DuPont KELDAX PE 6825 or KELDAX PE 6829R1 although other KELDAX grades such as 8208, 9104 or 9106 may be used. The mineral filler is preferably a dense material such as Calcium Carbonate or Barium Sulfate. The septum 34 has a thickness between 0.05 and 0.06 inch and a density of 0.5 lb./square foot (densities are given in terms of square feet because evaluation tests are run at a standard thickness). A 0.5 lb./square foot density is critical for achieving the desired acoustical qualities.

Figure 5:
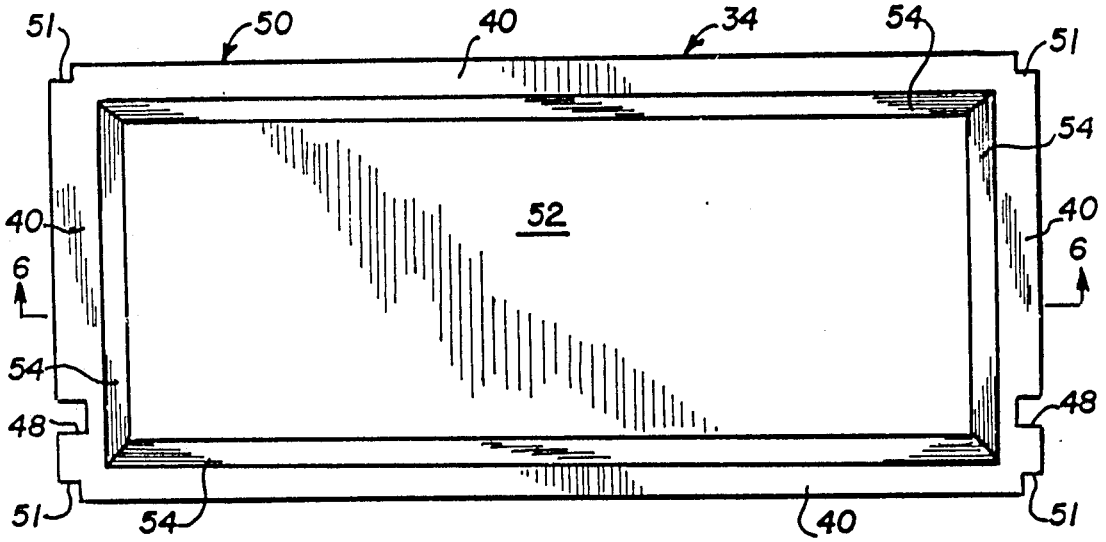
FIG. 5 is a plan view of a septum used in the acoustical wall tile according to the invention.
Figure 6:
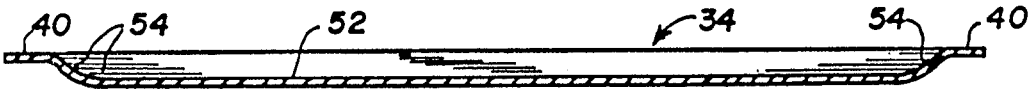
FIG. 6 is a cross-sectional view of the septum taken along lines 6—6 of FIG. 5.

The septum 34 is flexible and provides a means of sound damping and sound transmission reduction without the use of a metal septum. The flexibility of the septum 34 provides a pliable sound barrier which yields to wiring or other components which may be mounted within the framework of the wall system to which the acoustical tile is mounted. The KELDAX material is moldable and pliable, yet has excellent sound transmisson attenuation qualities. FIGS. 5 and 6 show the geometry of the septum 34. A vacuum molding process is used to manufacture the septum 34. The septum 34 outer contour 50 is generally rectangular in shape. Cutout portions 48 are required for placement of a support bracket 122. Cutout portions 51 are required to accommodate tucking of the fabric overwrap 14 into the tile frame as will hereinafter be described.

The septum 34 shown in FIGS. 5 and 6 is for the 24- and 30-inch tiles 10. It includes a single rectangular pan-shaped depression 52. The bulk of the low-density material 32 volume is located within the depression 52. FIGS. 5 and 6 illustrate that the side portions 54 of the pan-shaped depressions 52 slope forwardly to meet a flange portion 40. The flange portion 40 is placed within the channels 45, 47 of the upper and lower rails 18 and end caps 20, respectively, to secure the septum 34 in place.

Figure 13:
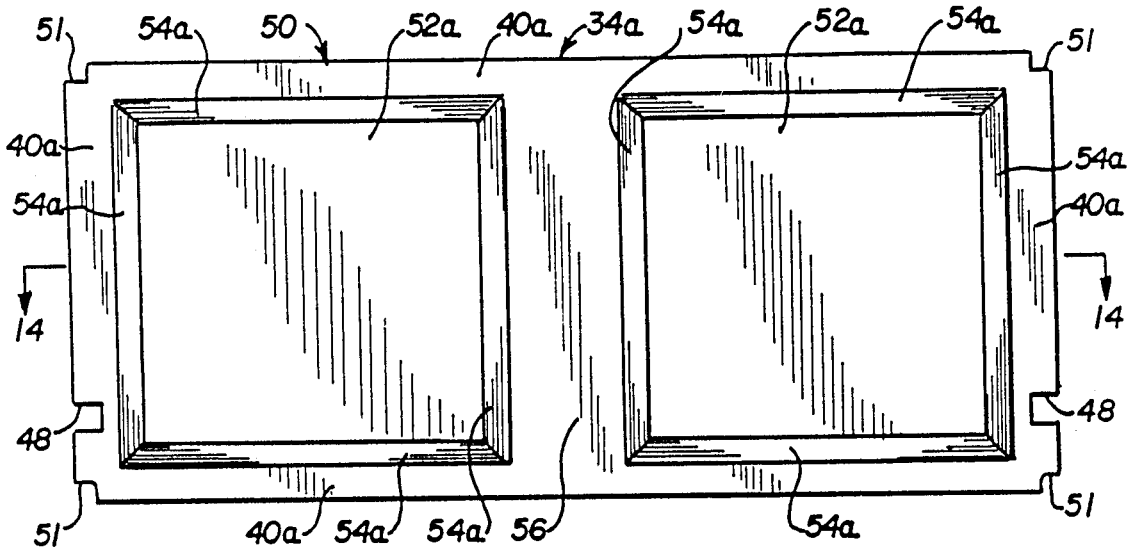
FIG. 13 is a plan view of a septum used in an acoustical tile that has a rear cross brace.
Figure 14:
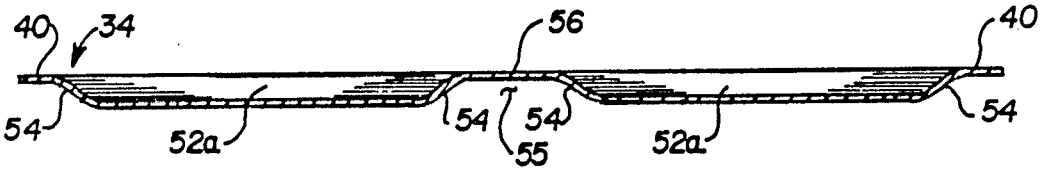
FIG. 14 is a cross-sectional view along lines 14—14 of the septum shown in FIG. 13.

Because the 36-, 42- and 48-inch tiles 10 require a cross brace 80 across the middle portion 106 of the tile rear face 88, a septum 34*a* for these tiles must be modified to be compatible. As seen in FIGS. 13 and 14, the septum 34*a* used for the larger tiles includes two bilateral square pan-shaped depressions 52*a* and a flat central portion 56. The cross brace 80 is inserted in the space 55 between the pan-shaped portions 52a so the brace 80 is parallel to the septum central portion 56.

The bul of the low density material 32 volume is located within the depressions 52a. FIG. 14 illustrates that the side portions 54a of the pan-shaped depressions 52a slope forwardly to meet a flange portion 40a and the central portion 56 of the septum 34a. As with septum 34, the flange portion 40a is placed within the channels 45 and 47 of the upper and lower rails 19, 18 and end caps 20, 21 respectively to secure the septum 34a in place.

The density of the septum 34, 34a must be kept to 0.5 lb./square foot to achieve the desired results. However, adequate results are achieved for the high-density material 22 if the density is kept between 3.6 and 4.0 lbs./cubic foot and for the low-density material 32 if its density is kept between 0.6 and 0.8 lbs./cubic foot. The thicknesses of the high-density and low-density materials 22, 32 may be varied by ÷1/32 inch. However, acoustical characteristics require the septum 34, 34a, to be held within a 0.05–0.06 inch thickness range. By maintaining these tolerances, the acoustical qualities of the tile 10 will be retained, and the components will be assured of fitting within the tile frame channels 45 and 47.

The high density material 22, low density material 32, and the septum 34, 34a are dimensioned at outer portions 38, 40, 42 so they fit securely within the channel portions 45 and 47 of the rails 18, 19 and end caps 20, 21 respectively by a compression fit as indicated in FIG. 4. FIG. 4 illustrates the location of the outer edges 24, 25, 26 of the septum 34, high density material 22 and low density material 32 after the tile 10 is assembled.

The high-density board 22, low-density board 32, and septum 34 have a plurality of cutout portions (not shown) located along their vertical edges that match cutout portions 64, 77, 79, 81 of the rails 18, 19 and end caps 20, 21. The cutout portions of the high density board 22, low density board 32, and septum 34 are required to facilitate placement of frame hooks 76, spring clips 78 and a metallic support bracket 122 and the tucking of the overwrap onto the acoustical wall tile 10 as will hereinafter be described in detail.

Figure 15:
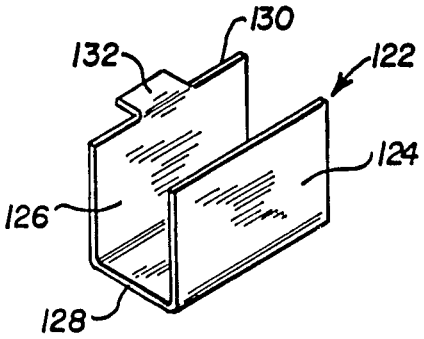
FIG. 15 is a perspective view of an end cap support bracket.

As seen in FIGS. 11 and 15, there is a metallic support bracket 122 that is located at each end cap hole 79 into which are placed clips 78 that aid in the attachment of the tile 10 to the wall frame 12. The bracket 122 is U-shaped in cross section and comprises a front portion 124, a rear portion 126, and a web portion 128. Each portion 124, 126, 128 is approximately one inch wide. An upper edge 130 of the rear portion 126 has a lip portion 132 that extends at a right angle to the rear portion 126. The width of the lip 132 is slightly less than the width of a side portion 134 of the clip hole 79. A bracket 122 is inserted into each end cap 20, 21 prior to assembly of the tile frame 28. The bracket web portion 128 is inserted so it abuts the end cap web portion 72 and so the lip 132 extends through the side portion 134 of hole 79 and is directed toward the vertical edge 136 of the rear end cap portion 70. The function of the bracket 122 is to provide structural support for the end caps 20, 21 so they will not warp under the forces exerted during installation and removal of the tile 10 on the wall frame 12. Cutout portions 48 in the septum 34, 34a are necessary to provide clearance for the bracket 122 of each end cap 20, 21.

Referring to all the figures, the assembly of the tile 10 will now be described in detail. The upper and lower rails 19, 18 and lateral side end caps 20, 21 are assembled to form a tile frame 28 as shown in FIG. 11. The frame 28 is securely fastened together, preferably by a TOG-L-LOC means described in U.S. Pat. No. 4,459,731 to Sawdon. As best seen in FIGS. 3 and 11, the TOG-L-LOC means uses a punch to deform overlap portions of the rails 18, 19 and end caps 20, 21 that exist at upper and lower corner portions 108, 110 of the frame 28. The deformed portions thereby interlock the end caps 20, 21 to the rails 18, 19. This operation, which is done by an automatic TOG-L-LOC machine, permits the rails 18, 19 and end caps 20, 21 to be joined together, even if they are pre-painted prior to assembly. The rail stepped portions 64 and end cap cutout portions 81 combined at each upper and lower corner 108, 110 to form holes 112. The holes 112 are used to tuck the fabric overwrap 14 into the frame 28. The rear portions 60, 70 of the rails 18, 19 and end caps 20, 21 form a plane for the tile rear face 88. Their front portions 58, 68 form a plane for a tile front face 16.

Figure 12:
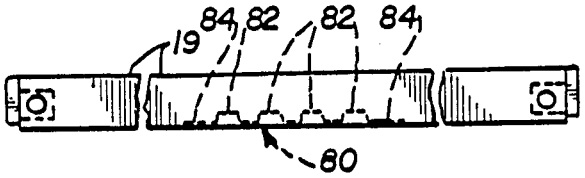
FIG. 12 is a top fragmentary view of the acoustical tile showing the cross brace.

As illustrated in FIGS. 11 and 12, for tiles 10 larger than 30 inches in rail length, the cross crace 80 is installed to provide structural support for the acoustical tile 10. For these tiles the septum 34a is used. The brace 80 is composed of a metal such as steel and is rectangular in shape and has several horizontally spaced vertical channel portions 82 and two vertical flange portions 84. The brace 80 is rigidly fastened as by rivets or a TOG-L-LOC means at locations 86 on the rear portion 60 of each rail 18, 19. The brace 80 is positioned so it fits across the middle portion 56 of the septum 34a and adjacent to the pan-shaped depressions 52a. The cross brace 80 is attached to the rails 18, 19 during the frame 28 assembly.

Next, a stack (not shown) is formed comprising the septum 34 or 34a, low-density material 32, and high-density material 22. The stack is placed on a lower portion of a press (not shown). The tile frame 28 is placed on an upper portion of the press so that the frame rear face 88 is directed upward and so the stack is positioned below the frame 28. The stack is then pressed into the frame 28, thereby inserting the stack components within the rail and end cap channels 45, 47. It is during this operation that the outer portions of the low-density material become compressed and thereby form flanges 38.

Because the septum 34, 34a is made of a rubber polymer, it retains its ability to lie flat during the tile assembly process. This enables the tile to be placed on an automated machine that can automatically wrap the fabric 14 over the tile 10 and install the hooks 76 and clips 78 that are shown in FIG. 2. Conventional tiles use metal septums which often become warped and therefore so not lie flat. The warping makes it impossible for the automated equipment to perform the wrapping and hook and clip installation operation for the metallic septums.

Referring to FIG. 2, prior to placing the tile 10 on the automated machinery, a spray adhesive is sprayed onto tile frame edges 114, 116, 118, 120 to hold the overwrap 14 onto the tile during the wrapping process. The tile 10 is then placed on the wrapping machine. The machine automatically wraps and secures by an adhesive means the overwrap 14 to tile frame edge portions 114, 116, 118, 120 and back face 88. For Class A fire rating, no adhesive is allowed on the tile front face 16. It also tucks the corner portions of the overwrap 14 into the frame holes 112.

Also prior to installation of the tile 10 onto the wrapping machine, one of the rails 18 is preselected as identifying a bottom edge 118 of the tile 10, leaving the second rail 19 to identify an upper edge 114 of the tile 10. As shown in FIG. 2, a hook 76 is inserted in each end cap hole 77 which is near the tile bottom edge 90. Upon installation of the tile 10 onto a wall frame 12, the hooks 76 are inserted into mating holes in the wall frame 12. A clip 78 is placed within each end cap hole 79 that is located near the tile upper edge 92. Upon installation of the tile 10 onto the wall frame 12, the clips 78 are inserted into mating holes on the wall frame 12 to secure the tile 10 to the frame 12. The wrapping machine automatically inserts the hooks 78 anc clips 78 into their respective frame holes 77, 79.

Laboratory tests for acoustic tiles 10 demonstrate that the tiles are able to attain a Sound Transmission Class (STC) rating of up to 28 and a Noise Reduction Coefficient (NRC) of up to 0.80. The tile 10 also attains a Class A Interior Finish Rating which means there is no smoke or fire generation. The acoustical test specimen comprises a plurality of panels. The septums were made of KELDAX 6825 with a thickness of 0.06 inches and a density of 0.5 lb./square foot. The high-density material consisted of 0.5-inch thick AWP board with a density of 3.6 lb./cubic ft. The low-density material comprised a 1-inch thick microlite fiberglass with a density of 3.6 lb./cubic ft. The outer surface was covered by a silk-weave fabric. Ten tiles comprised the specimen. The overall dimensions of the specimen were 48 inches wide by 86 inches high by 3.500 inches thick.

While the invention has been described in connection with the preferred embodiment, it will be understood that the invention is not limited to that embodiment. To the contrary, the invention can extend to all alternative modifications and equivalents as may be included within the spirit and scope of the invention as defined by the appended claims.

The embodiments of the invention in which an exclusive property or privilege is claimed are defined as follows:

1. An acoustic tile for mounting to a rigid frame to provide sound transmission attenuation and sound-deadening characteristics to a wall comprising one or more of said acoustic tiles, said tiles comprising:

a relatively rigid frame defining an open central portion;

a first acoustic layer of a high-density acoustic material conforming to the perimetric shape of the frame and mounted in the open central portion thereof, said first acoustic layer being relatively rigid and providing structural rigidity to said rigid frame;

a second acoustic layer of a relatively compressible, low-density acoustic material, conforming to the perimetric shape of said frame and mounted in the open central portion thereof in facing relationship to said first acoustic layer;

a septum formed of a flexible sound-transmission blocking material, also conforming to the perimetric shape of said frame, and mounted in the open central portion thereof in facing relationship to said second layer of acoustic material;

said first acoustic layer, said second acoustic layer and said septum being of densities and thicknesses to provide sound-transmission class rating of at least 28.

2. An acoustic tile according to claim 1 wherein said septum is made of a moldable rubbery polymer.

3. An acoustic tile according to claim 2 wherein said septum is a mineral-filled rubbery polymer.

4. An acoustic tile according to claim 3 wherein said mineral is calcium carbonate.

5. An acoustic tile according to claim 4 wherein the septum has at least one pan-shaped depression at a central portion thereof and said depression is filled with said second acoustic layer.

6. An acoustic tile according to claim 5 wherein the septum has a thickness of about 0.05 inches.

7. An acoustic tile according to claim 6 wherein said first acoustic layer has a thickness of about 0.5 inches.

8. An acoustic tile according to claim 7 wherein said first acoustic layer has a density of about 3.6 pounds per cubic foot.

9. An acoustic tile according to claim 8 wherein said second acoustic layer has a maximum thickness of about 1 inch.

10. An acoustic tile according to claim 9 wherein said second acoustic layer has a density of about 0.6 pounds per cubic foot.

11. An acoustic tile according to claim 10 and further comprising a fabric wrap surrounding said frame and said first acoustic layer.

12. An acoustic tile according to claim 8 wherein said second acoustic layer has a density of about 0.6 pounds per cubic foot.

13. An acoustic tile according to claim 3 wherein said first acoustic layer has a density of about 3.6 pounds per cubic foot and said second acoustic layer has a density of about 0.6 pounds per cubic foot.

14. An acoustic tile according to claim 13 and further comprising a fabric wrap surrounding said second frame and said first acoustic layer.

15. An acoustic tile according to claim 4 wherein said septum has a thickness of about 0.05 inches.

16. An acoustic file according to claim 15 wherein said first acoustic layer has a density of about 3.6 pounds per cubic foot and said second acoustic layer has a density of about 0.6 pounds per cubic foot.

17. An acoustic tile according to claim 16 wherein said first acoustic layer has a thickness of about 0.5 inches and said second acoustic layer has a maximum thickness of about 1 inch.

18. An acoustic tile for mounting to a rigid frame to provide sound transmission attenuation and sound-deadening characteristics to a wall comprising one or more of said acoustic tiles, said tiles comprising:

a relatively rigid frame defining an open central portion;

a first acoustic layer of a high-density acoustic material conforming to the perimetric shape of the frame and mounted in the open central portion thereof, said first acoustic layer being relatively rigid and providing structural rigidity to said rigid frame;

a second acoustic layer of relatively compressible, low-density acoustic material, conforming to the perimetrical shape of said frame and mounted in the open central portion thereof in facing relationship to said first acoustic layer;

a septum formed of a flexible sound-transmission blocking material, also conforming to the perimetric shape of said frame, and mounted in the open central portion thereof in facing relationship to said second layer of acoustic material, said septum being made of a moldable rubbery polymer and being relatively yieldable to deform when forced against components in said wall.

19. An acoustic tile according to claim 18 wherein said septum is a mineral-filled rubbery polymer.

20. An acoustic tile according to claim 19 wherein said mineral filler is calcium carbonate.

21. An acoustic tile according to claim 18 wherein said first acoustic layer has a density of 3.6 pounds per cubic foot and said second acoustic layer has a density of about 0.6 pounds per cubic foot.

22. An acoustic tile according to claim 21 wherein said first acoustic layer has a thickness of about 0.5 inches and said second acoustic layer has a maximum thickness of about 1 inch.

23. An acoustic tile according to claim 22 and further comprising a fabric wrap surrounding said frame and said first acoustic layer.

* * * * *